United States Patent [19]

DuBroff

[11] 4,230,519

[45] Oct. 28, 1980

[54] TAPE APPLYING APPARATUS

[75] Inventor: Warren DuBroff, Highland Park, Ill.

[73] Assignee: Lathrop Paulson Company, Chicago, Ill.

[21] Appl. No.: 940,494

[22] Filed: Sep. 8, 1978

[51] Int. Cl.[2] ..... B09C 17/00

[52] U.S. Cl. ..... 156/468; 53/588; 156/475; 156/486

[58] Field of Search ..... 156/475, 505, 506, 486, 156/468; 53/399, 588

[56] References Cited

U.S. PATENT DOCUMENTS

| | | | |
|---|---|---|---|
| 1,220,556 | 3/1917 | Reisbach | 156/505 |
| 3,527,634 | 9/1970 | Nelson | 156/506 |
| 3,600,253 | 8/1971 | Derenthal | 156/486 |
| 3,950,203 | 4/1976 | Van der Wal | 156/468 |

*Primary Examiner*—David A. Simmons

*Attorney, Agent, or Firm*—McDougall, Hersh & Scott

[57] ABSTRACT

An apparatus for applying strips of tape around objects positioned adjacent the apparatus. A pair of tape holding reels are supported for movement in a path extending around the position occupied by the object. A tape end is applied to a surface of the object, and drive means are then operated for moving the tape reels around the object. The tape is thereby unreeled and automatically applied to the object surface. At the end of the track, or other means defining the path, severing means are utilized for separating a severed end from a reel whereby this severed end can be attached to an object surface to thereby complete the tape applying operation. The respective reels are inverted relative to each other with one reel being utilized for application of tape during movement of the reels in one direction and with the other reel being utilized for application of tape during movement in the opposite direction.

7 Claims, 4 Drawing Figures

TAPE APPLYING APPARATUS

BACKGROUND OF THE INVENTION

This invention relates to an apparatus for applying tape to an object. In a typical application, the object may comprise a stack of cartons or the like, and the tape is applied for purposes of maintaining the stack in a stable condition, for example while the stack is being moved by conveyor means from one location to another.

The invention has a utility in connection with various devices such as stackers. Such stackers include means for supporting a pallet, and means for locating the pallet at an elevated position. A platform is utilized by a worker, and a conveyor feeds cartons to the worker so that the worker can move the cartons onto the pallet. When a layer of cartons is in place, the equipment is adapted to lower the pallet whereby the worker can then provide an additional layer on top of the first layer.

Layers may be built up on pallets to heights in the order of seven feet or more, and the loaded pallets are then usually moved to storage locations by conveyor means which may include a lift truck. In view of the handling involved, there is a tendency for cartons to be dislodged whereby time can be lost and goods damaged. In order to stabilize objects of the type described, the upper layer at least has been bound with tape or the like. By holding at least the upper layer in assembly, there is a greatly decreased tendency toward dislodging of cartons.

It has been found, however, that the tape applying operation represents a time-consuming and awkward job. Where relatively large objects are involved, it is often necessary for a worker to crawl onto machinery of the type described in order to apply tape all around an object. In addition to being time-consuming and awkward, this can be a dangerous practice since the workers position when applying tape to an upper layer may be well above ground level.

SUMMARY OF THE INVENTION

This invention provides a means for applying tape to objects which overcomes the problems previously encountered. The invention involves the use of means for applying tape to an upper layer of a stack of cartons or to other objects. The tape applying means includes tape holding reels and support means for the reels. A track, supporting arm, or other means are utilized for controlling the movement of the reels during operation of the device.

In one embodiment, a track is utilized for guiding the reel movement. The track is preferably of U-shaped configuration extending along one side of an object, across the back of the object, and then along the other side. The reels are supported on a chain or the like which is engaged with the track, and a drive motor serves to control the reel movement. Where a chain is utilized, sprockets are employed whereby operation of the motor will drive the sprockets and the reel supporting chain.

The preferred form of the invention involves the use of a pair of reels mounted co-axially on the chain. The reels are inverted relative to each other whereby the adhesive surfaces of the tape face in opposite direction. With this arrangement, the tape on one reel is utilized for application to an object when the reels are driven from one end of the track to the other. The tape on the other reel is then utilized when the reels are driven in the reverse direction around the next object being handled.

DETAILED DESCRIPTION OF THE DRAWINGS

Figures 1, 4:
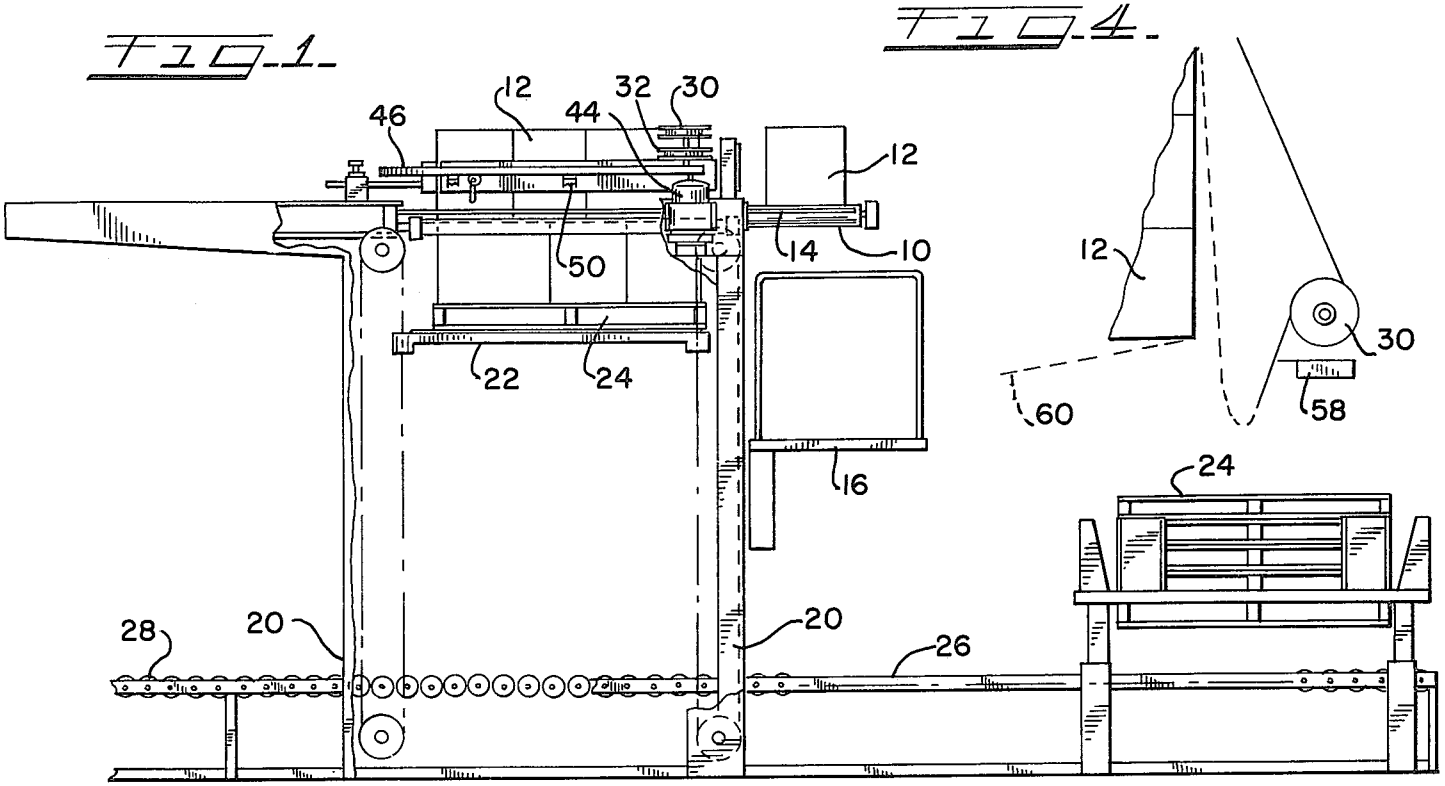
FIG. 1 is an elevational view of a carton stacker or the like having a tape-applying means associated therewith.
FIG. 4 is a schematic view illustrating tape-applying stages of the operation.
Figure 2:
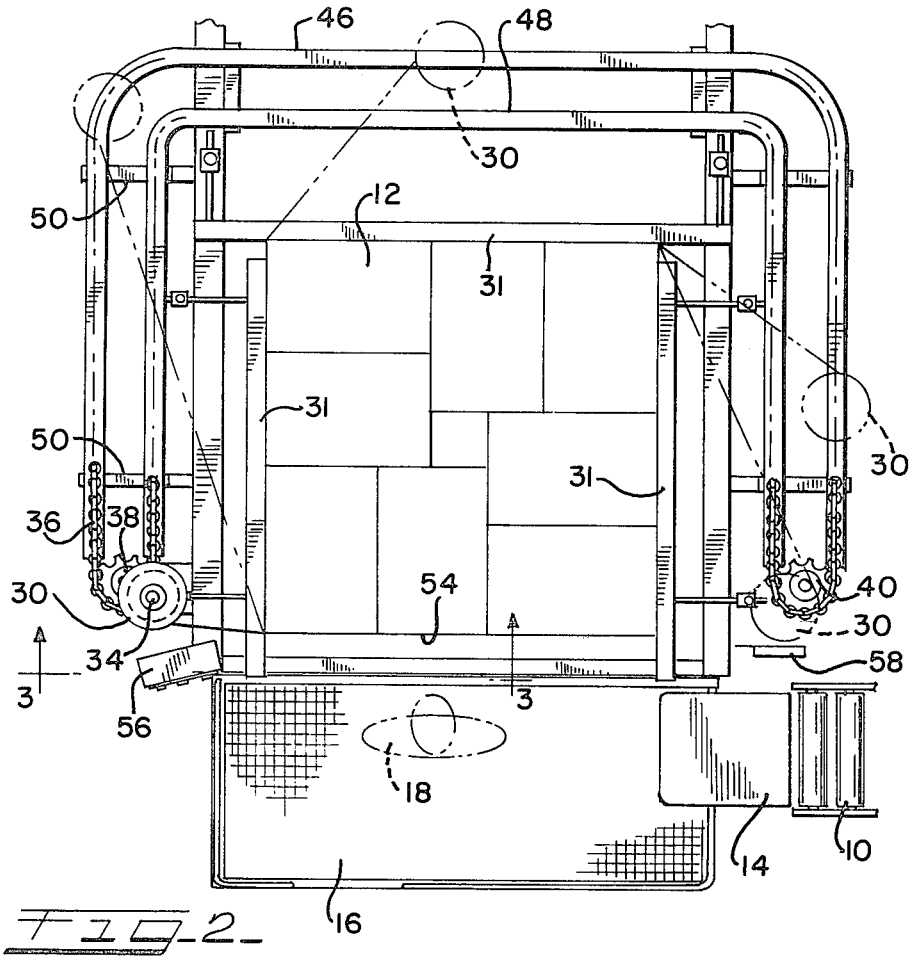
FIG. 2 is a plan view of the structure shown in FIG. 1.

FIGS. 1 and 2 illustrate a pallet loader construction. This construction includes an input conveyor 10 which delivers cartons 12 to a table 14. An elevated platform 16 is positioned for supporting a worker 18 adjacent the table 14.

The construction further includes vertical supporting legs 20 which define a vertical shaft for elevator 22. The floor of the elevator is provided for supporting pallet 24. A lower conveyor 26 is provided for delivering fresh pallets to the elevator shaft. An output conveyor 28 is employed for moving loaded pallets out of the shaft.

In the usual operation of the conventional structure referred to, an empty pallet 24 is elevated to a loading position, and the worker 18 then arranges a plurality of cartons 12 in a layer with the aid of adjustably positioned bars 31. When a layer is completed, the elevator is lowered, and the worker is then able to form successive layers. When the last layer is in place, the worker will conventionally apply tape around the sides of the top layer. It will be appreciated that a time-consuming and awkward operation would be involved if the worker applied this tape manually.

In accordance with this invention, tape reels 30 and 32 are supported in the apparatus. These reels are mounted on a common shaft 34, and this shaft is connected to drive chain 36. The chain 36 extends around a first sprocket 38 on one side of the apparatus, and a second sprocket 40 on the other side of the apparatus. The sprocket 38 is fixed to shaft 42 of drive motor 44.

Spaced apart U-shaped tracks 46 and 48 receive the chain 36. These tracks extend in a U-shaped configuration around the location for loading the cartons 12. Braces 50 serve to support the track, these braces being connected to the main frame of the apparatus. Similarly, a motor mounted plate 52 holds the motor 44 in position on the apparatus.

Figure 3:
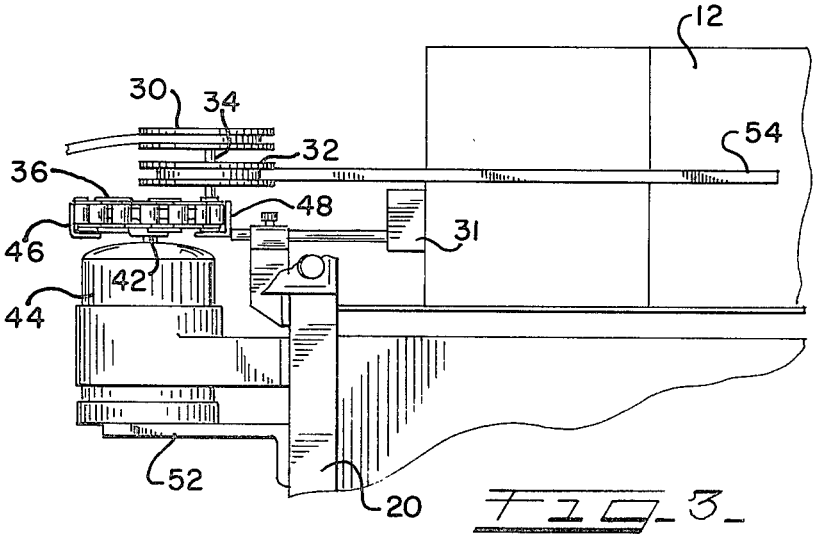
FIG. 3 is a fragmentary sectional view taken about the line 3—3 of FIG. 2.

FIGS. 2 and 3 illustrate one end 54 of the tape on reel 32. This end is applied at a first location to the surface of a carton 12. With a tape end applied in this fashion, the motor 44 is started. A control panel 56 may be located in a convenient position for the worker so that the worker can engage the start button on the panel immediately after applying the tape end 54.

The motor 44 operates to drive the tape reels around the layer of cartons from one end of the U-shaped track to the other. It will be appreciated that this action, as shown in FIG. 2, operates to automatically apply the tape to one side of the layer and to the back of the layer.

The reel is stopped as shown in FIG. 4 with the tape in the solid line position shown.

After driving movement of the reel 30 in the manner described, a worker will grasp the tape and manually unreel the tape for completing the tape applying operation. The worker then will sever the tape and move the severed end 60 onto the carton surface. This is shown in dotted lines in FIG. 4. It is preferred that the end 60 overlap the end 54 to some extent to thereby provide a more secure bond.

Severing of the tape may be accomplished with a knife or other tool carried by the worker. On the other hand, the invention also contemplates the provision of a stationary cutting mechanism 58. This mechanism may include a sharp edge whereby separation of the tape can be readily accomplished.

After the next layer of cartons to be taped has been moved into position, the tape reel 30 may be employed for applying the next strip of tape. Thus, it will be appreciated that the adhesive face of tape 30 is oriented in a direction opposite the adhesive face of the tape on reel 32. By providing two reels in the fashion described, it is not necessary to return the tape reels to the starting position after each tape applying operation. Thus, the two reels of tape permit the application of tape around the entire object being handled during both the forward movement of the tape and the return movement. As shown in FIG. 2, when a tape end has been severed, this end is readily available for use as the lead end of tape in a later tape applying operation.

It will be appreciated that the structure described is capable of applying tape on every layer placed on the pallet In addition, the structure is suitable for applying tape to objects of many different configurations.

The track employed for supporting the reels may be replaced by a supporting arm structure or any other suitable means for maintaining the reels in a predetermined path. The supporting arm may comprise, for example, a rotating arm mounted on a bracket positioned in the plane shown occupied by the track.

It will be understood that various other changes and modifictions may be made in the above described construction which provide the characteristics of the invention without departing from the spirit thereof particularly as defined in the following claims.

That which is claimed is:

1. In an apparatus for applying strips of tape around objects positioned adjacent the apparatus, the improvement comprising a pair of tape holding reels, support means for said reels, a path extending around the position occupied by said objects, and means for driving said support means along said path, a tape end from one of said reels being applied to each object at a first location on the surface of the object, a portion of said tape being unreeled from said one reel as the support means moves around the object whereby the tape is applied over the object surface, and means for severing the tape, the severed end of the unreeled tape portion being adapted to be applied to the object surface at a second location, said tape comprising pressure sensitive tape, said support means holding the tape on one reel in an inverted position relative to the tape on the second reel whereby the pressure sensitive surface of tape unreeled from said one reel faces in a direction opposite the pressure sensitive surface of tape unreeled from said second reel, the tape on said one reel being unreeled when driving the tape support means in one direction along said path, and the tape on the second reel being unreeled when driving the tape support means in the opposite direction along said path.

2. An apparatus in accordance with claim 1 wherein said path is defined by a track.

3. An apparatus in accordance with claim 2 wherein said support means comprise a common axis for the reels, said reels being vertically spaced apart on the support means, a drive chain, means connecting the support means to the chain, and drive sprockets engaging said chain, said means for driving the support means being connected to said drive sprockets, said chain being movable along a path defined by said track.

4. An apparatus in accordance with claim 3 wherein said means for driving said support means comprises a reversing motor, and control means for starting and stopping said motor when said support means is located at the opposite ends of said track.

5. An apparatus in accordance with claim 2 in combination with a pallet loader, said objects being positioned on a pallet.

6. An apparatus in accordance with claim 5 wherein said pallet loader comprises a vertically movable platform supporting said pallet, said objects being stacked in a plurality of layers on the pallet with each layer being formed at a loading level and with said platform being dropped downwardly to permit formation of the next layer at said loading level, said reel support means being positioned at said loading level whereby said tape is applied to at least the last layer of objects supported on the pallet.

7. An apparatus in accordance with claim 6 wherein said track is U-shaped for movement of said reels along a side of a layer, across the back of a layer, and along the opposite side of the layer, said first and second locations for application of tape ends to an object surface being on the front of the layer.

* * * * *